US006464428B1

(12) United States Patent
Mikell

(10) Patent No.: US 6,464,428 B1
(45) Date of Patent: Oct. 15, 2002

(54) SYNTHETIC HAY BALE AND METHOD OF USING SAME

(76) Inventor: Mike Mikell, 5696 Reinke Dr., Crestview, FL (US) 32535

( * ) Notice: Subject to any disclaimer, the term of this patent is extended or adjusted under 35 U.S.C. 154(b) by 0 days.

(21) Appl. No.: 09/774,517

(22) Filed: Jan. 31, 2001

Related U.S. Application Data

(63) Continuation-in-part of application No. 09/405,320, filed on Sep. 24, 1999, now abandoned.

(51) Int. Cl.[7] ..... E02B 3/12
(52) U.S. Cl. ..... 405/15; 405/16; 405/21
(58) Field of Search ..... 405/15, 16, 21

(56) References Cited

U.S. PATENT DOCUMENTS

| | | | | |
|---|---|---|---|---|
| 5,039,250 A | * | 8/1991 | Janz | 405/15 |
| 5,595,458 A | | 1/1997 | Grabhorn | 405/258 |
| 5,605,416 A | | 2/1997 | Roach | 405/21 |
| 5,632,888 A | | 5/1997 | Chinn et al. | 210/163 |
| 5,678,954 A | * | 10/1997 | Bestmann | 405/16 X |
| 5,725,782 A | | 3/1998 | Chinn et al. | 210/767 |
| 5,786,281 A | | 7/1998 | Prunty et al. | 442/104 |
| 6,010,622 A | | 1/2000 | Chinn et al. | 210/164 |

FOREIGN PATENT DOCUMENTS

| | | | |
|---|---|---|---|
| JP | 0037333 | 2/1985 | 405/16 |
| WO | 9638635 | * 12/1996 | |

OTHER PUBLICATIONS

"Needlepunch Nonwoven Manufacturing" Mitch Chaplin 1994 pp. 2.1–2.4.
Internet article 1 "Thompson Culvert Company" Jul. 1998.

* cited by examiner

*Primary Examiner*—David Bagnell
*Assistant Examiner*—Sunil Singh
(74) *Attorney, Agent, or Firm*—Peter Loffler

(57) ABSTRACT

A synthetic hay bale and method are used to control water flow, soil erosion, and sediment flow at a construction site. The synthetic hay bale is made from a sheet member formed from ground carpet fibers that are packed together. The sheet member is rolled up to form a body member and the body member may be received within a mesh cover or may be strapped. A rod can be longitudinally inserted into the rolled up body member. The body member is secured to the ground by passing at least one stake through the body member or straddling the body member and inserting the stake into the ground.

38 Claims, 6 Drawing Sheets

SYNTHETIC HAY BALE AND METHOD OF USING SAME

This application is a Continuation-in-part of U.S. application Ser. No. 09/405,320 filed on Sep. 24, 1999, now abandonded.

BACKGROUND OF THE INVENTION

1. Field of the Invention

The present invention relates to a hay bale that controls water flow, land erosion, and sediment flow.

2. Background of the Prior Art

At many construction sites including road work projects, it is necessary to control water flow, soil erosion and sediment flow through and around the construction area. The current method for such control is to secure one or more hay bales in and around the areas of desired control. While using a standard hay bale works generally well, the hay bale comes with many drawbacks.

The hay bale, by being a natural product, can come laden with weeds and other contaminates that can cause substantial environmental damage at the construction site. The hay bale is relatively heavy and bulky making installation and removal of the hay bales difficult. The hay bale has a relatively short life span and must be discarded after its useful life. During unusual climatic periods, hay may be in short supply and therefore difficult to get to a construction site.

Therefore, there is a need in the art for a system that controls water flow, soil erosion and sediment flow in and around a construction site that overcomes the above drawbacks. Such a system should not be a natural product that is capable of transporting weeds and other contaminants and introducing the contaminants to the construction site. The system should not be unusually heavy and bulky to handle and should not have a relatively short shelf-life. Ideally, such a system will have a use after its initial usefulness has run.

SUMMARY OF THE INVENTION

The synthetic hale bale and method of the present invention addresses the aforementioned needs in the art. The present invention provides water flow, erosion and sediment flow control at a construction site without undue drawbacks. The invention is an industrial product that has minimal risk of weed spread. The synthetic hay bale is not unduly heavy and is relatively easy to handle. The synthetic hay bale has a relatively long life span and can be recycled after its initial usefulness has run.

The synthetic hay bale and method comprise a water permeable sheet member that is rolled up, the sheet member being made from packed carpet fibers. The sheet member is formed by any appropriate technique known in the art for producing such sheet members including needle punching (the fibers are formed into a batt and then introduced into a needle punch machine wherein the fibers are interlocked mechanically as the needles of the machine have spaced apart barbs thereon and the barbs, as the needles move up and down. pickup the fibers and lock them together), stitch bonding (a batt is formed and then stitched in a linear or cross direction to hold the batt together), chemical bonding (a batt is formed and then held together by introducing a chemical solution such as latex Acrylic, or other binder), and thermal bonding (low melt fibers are introduced into the batt and then batt is heated causing the low melt fibers to melt to hold the batt together). The sheet member is fixedly secured to the ground by passing a stake therethrough. The sheet member can received within a cover, the cover being formed from an appropriate mesh material and one or both ends of the cover are tied or otherwise closed off. If multiple synthetic hay bales are positioned along a lateral axis, then one sheet member is partially received within the cover of any adjoining sheet member and vice versa. The rolled up body member may be strapped into its rolled position by an appropriate strap such as string, wire, plastics strapping, etc. A rod can be inserted into the rolled up body member.

BRIEF DESCRIPTION OF THE DRAWINGS

Similar reference numerals refer to similar parts throughout the several views of the drawings.

DESCRIPTION OF THE PREFERRED EMBODIMENT

Figure 1:
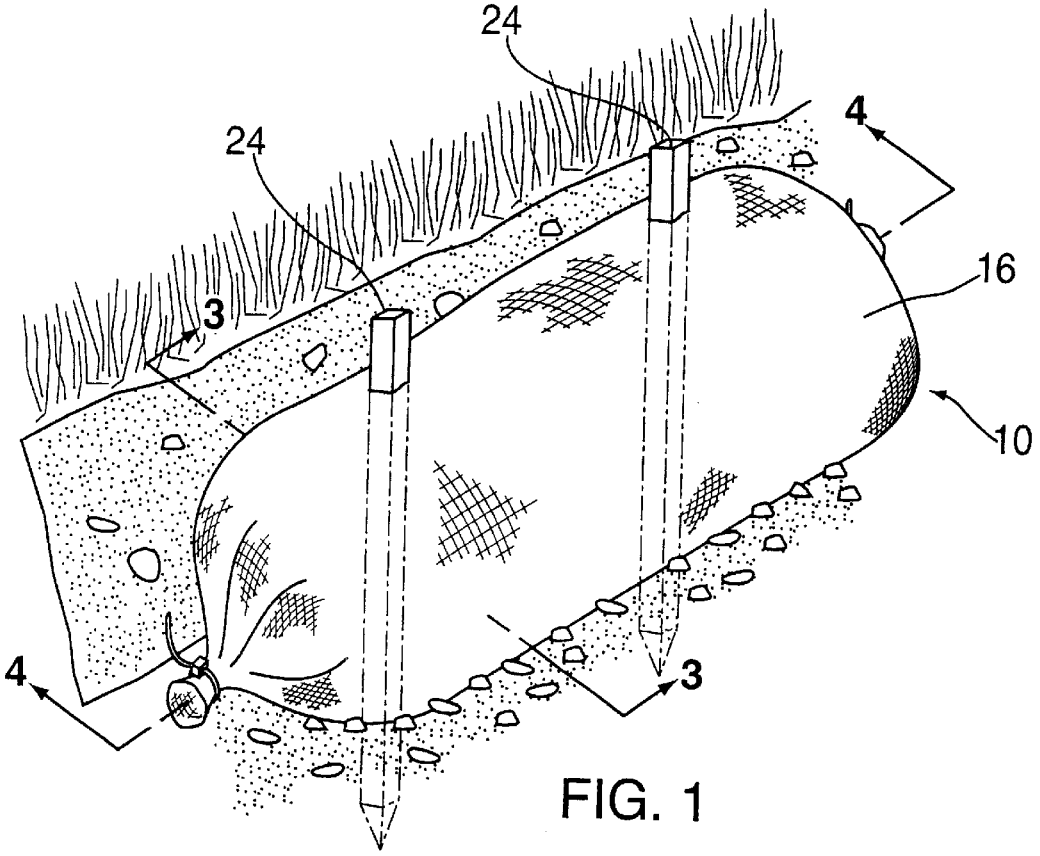
FIG. 1 is an environmental view of the synthetic hay bale of the present invention secured to the ground.
Figure 2:
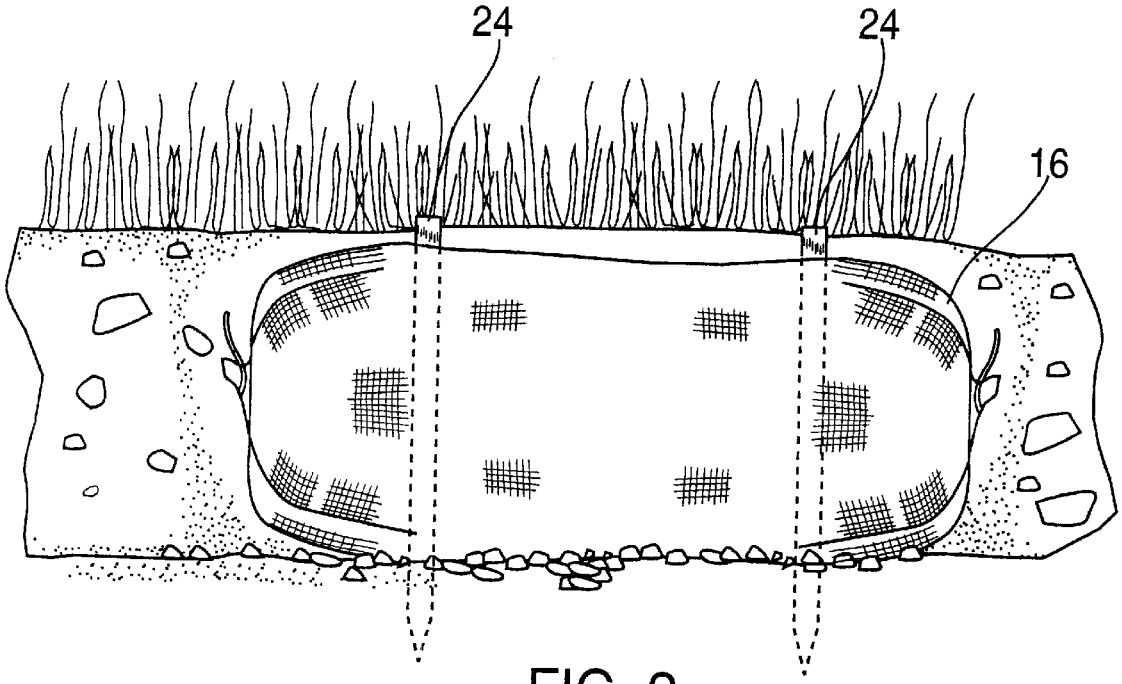
FIG. 2 is a front elevation view of the synthetic hay bale secured to the ground.
Figure 3:
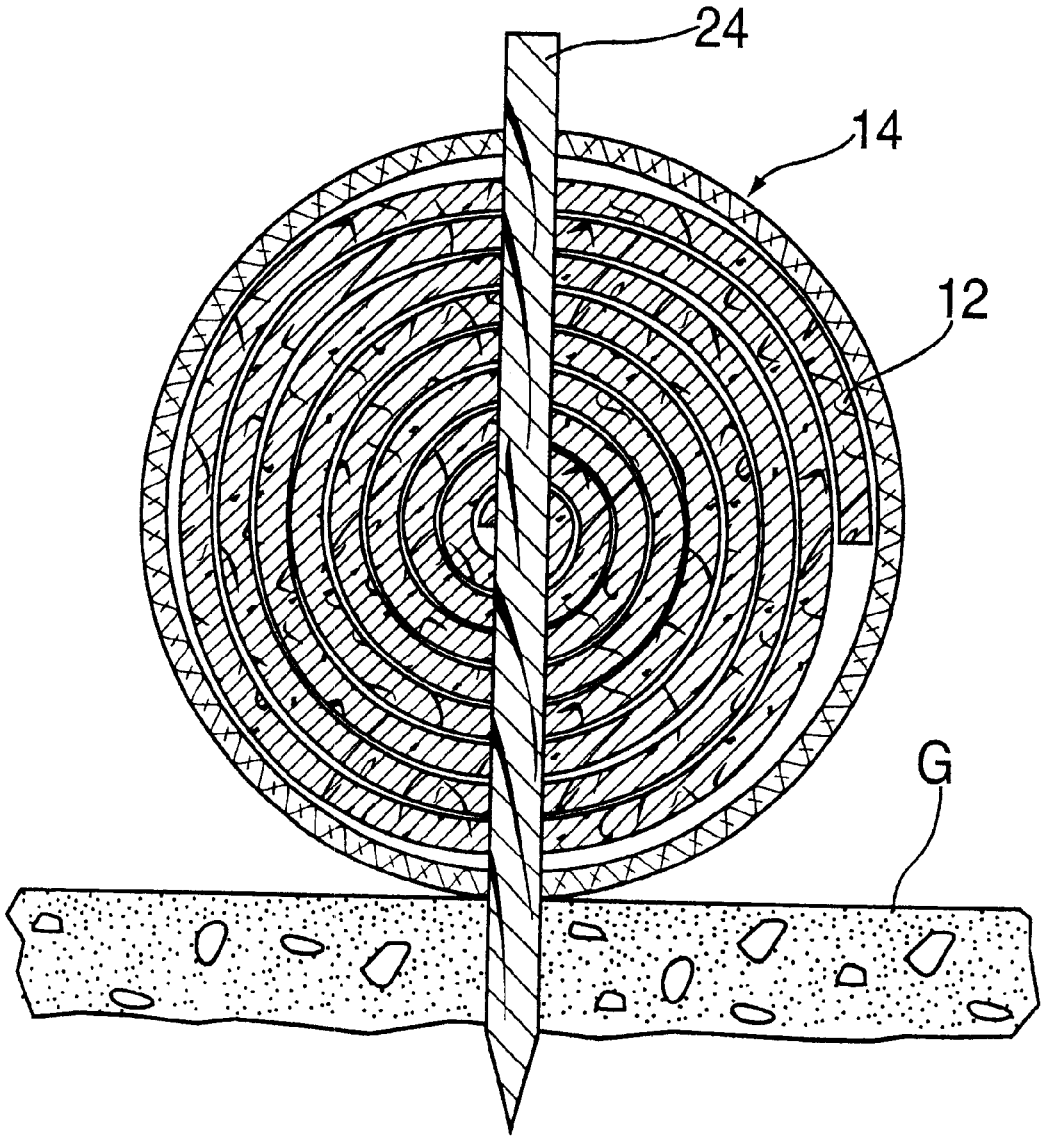
FIG. 3 is a side sectioned view of the synthetic hay bale secured to the ground taken along line 3—3 in FIG. 1.
Figure 4:
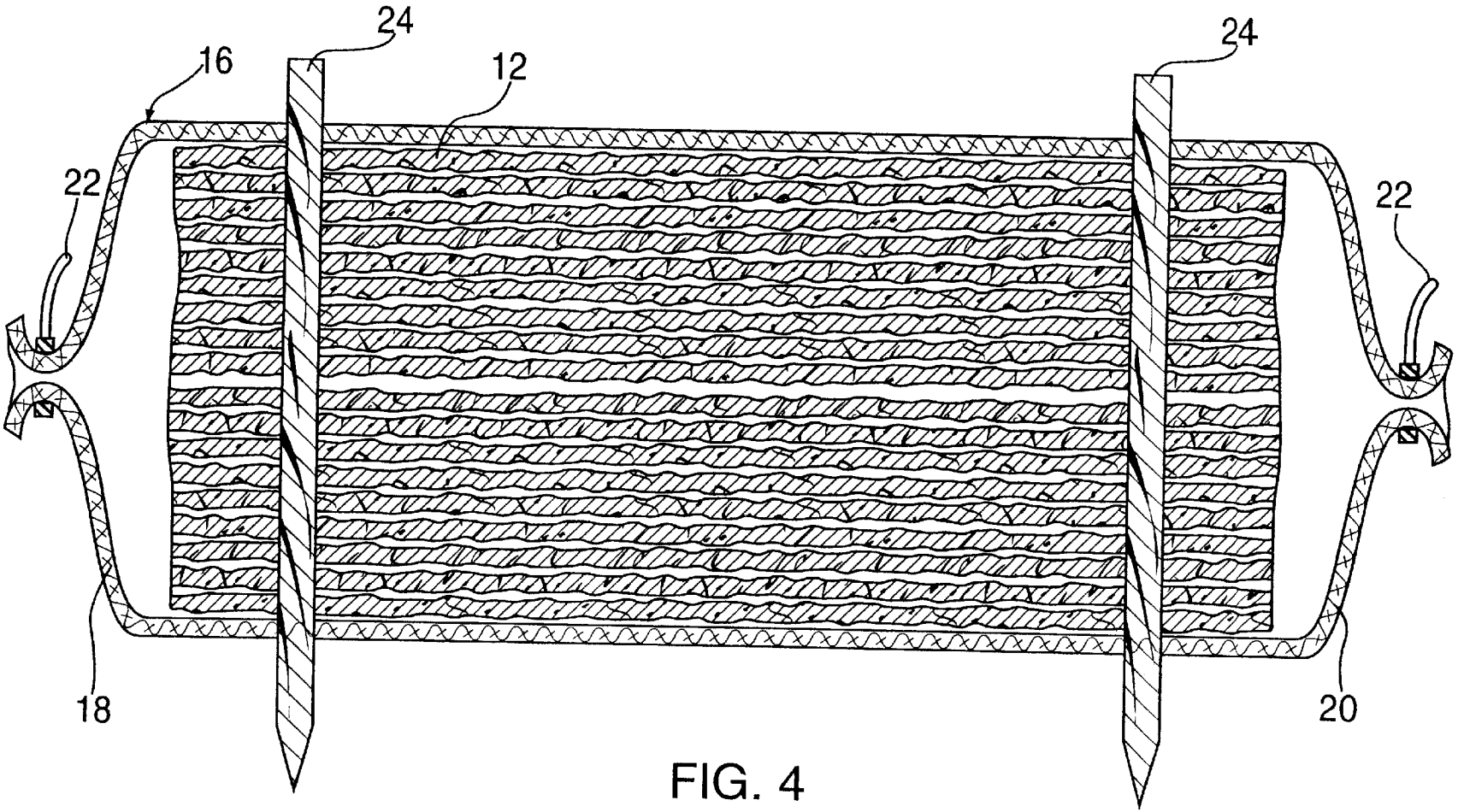
FIG. 4 is a front sectioned view of the synthetic hay bale secured to the ground along line 4—4 in FIG. 1.
Figure 5:
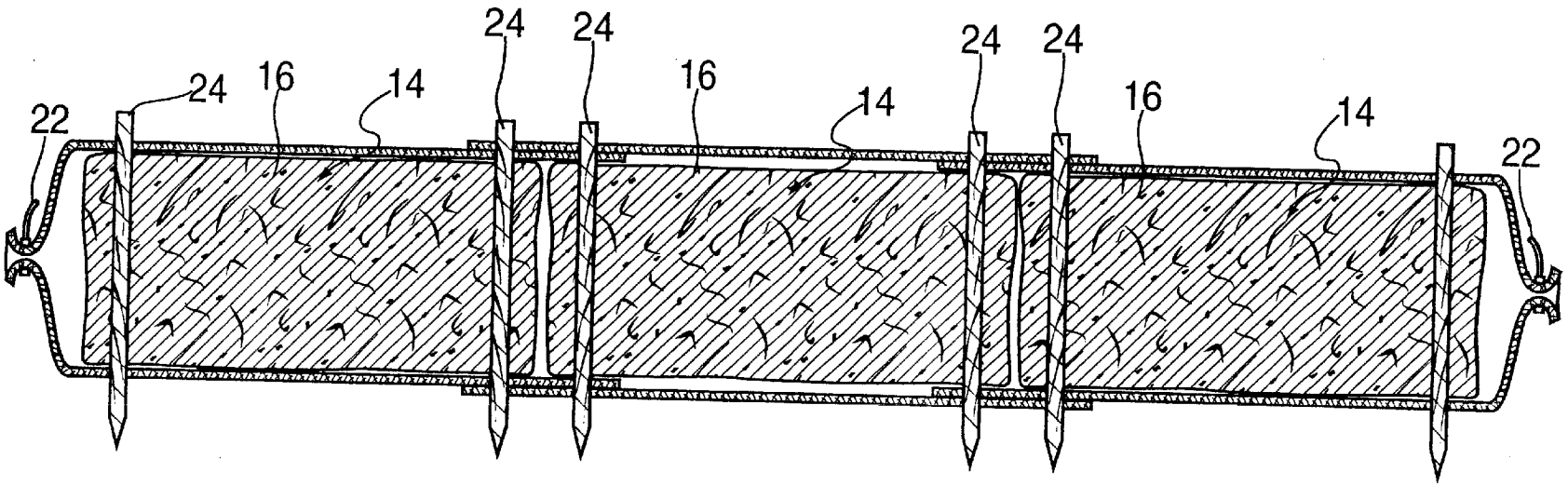
FIG. 5 is a front sectioned view of multiple synthetic hay bales of the present invention positioned along a lateral axis.
Figure 6:
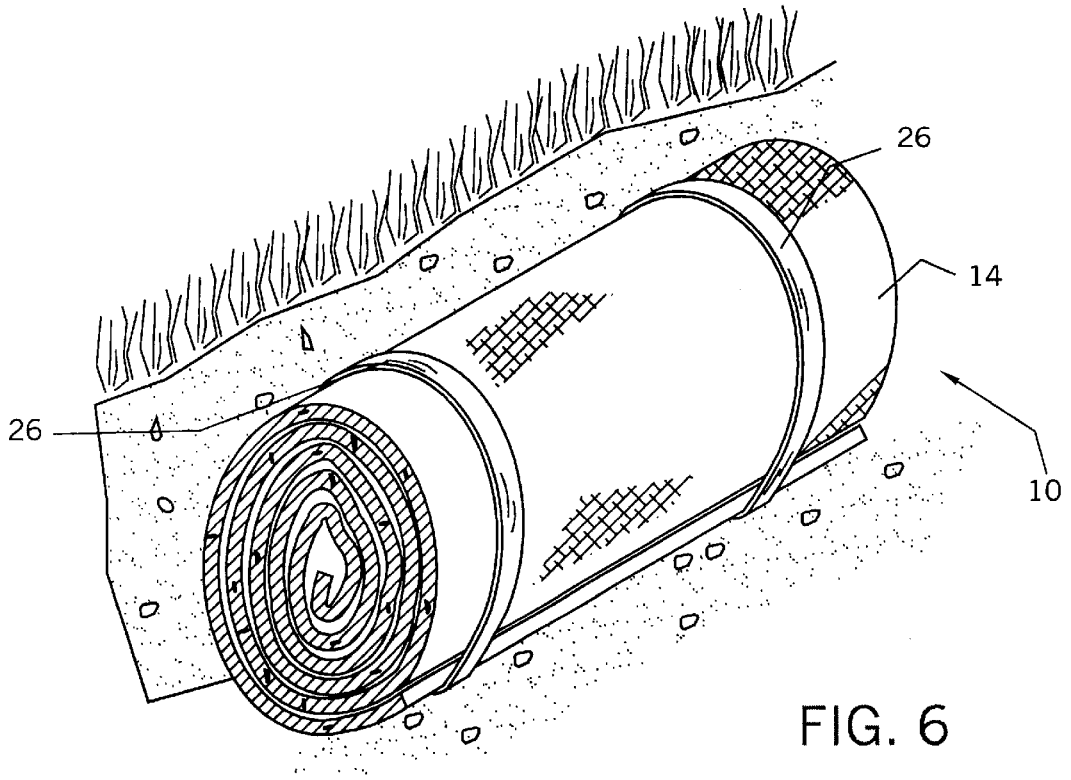
FIG. 6 is an environmental view of the synthetic hay bale of the present invention wherein the rolled up body member is encompassed by a strap.
Figure 7:
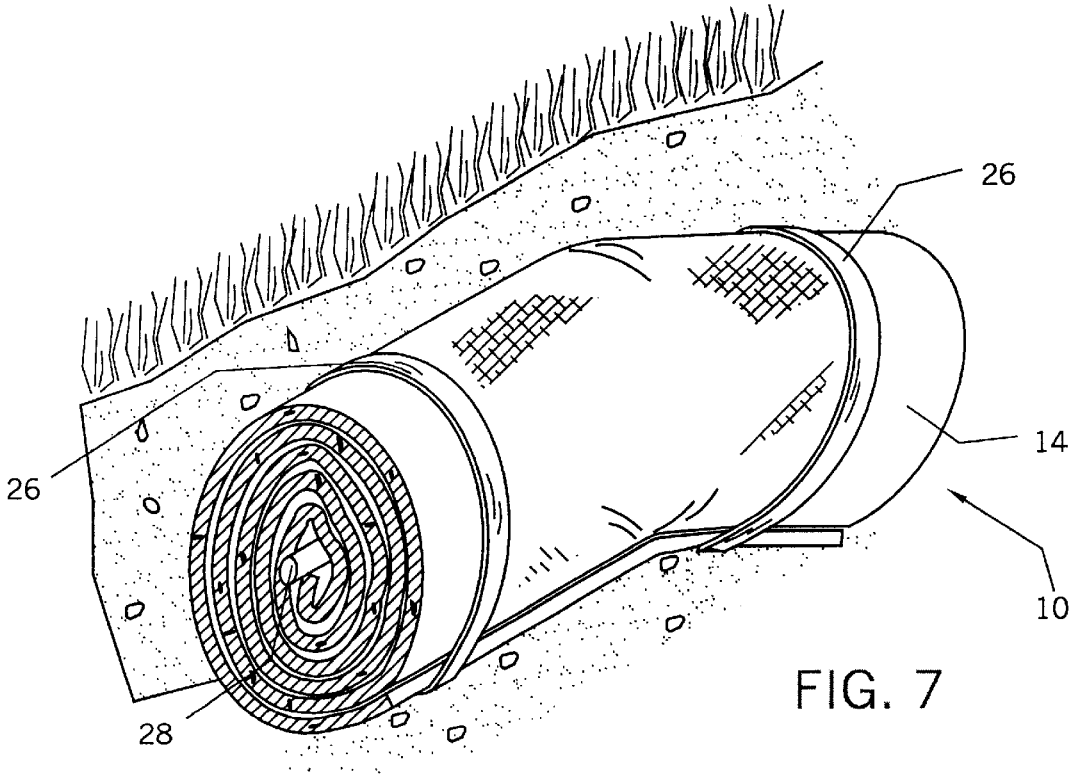
FIG. 7 is an environmental view of the synthetic hay bale of the present invention wherein a rod is passed through the rolled up body member and the body member is bent to a desired shape.
Figure 8:
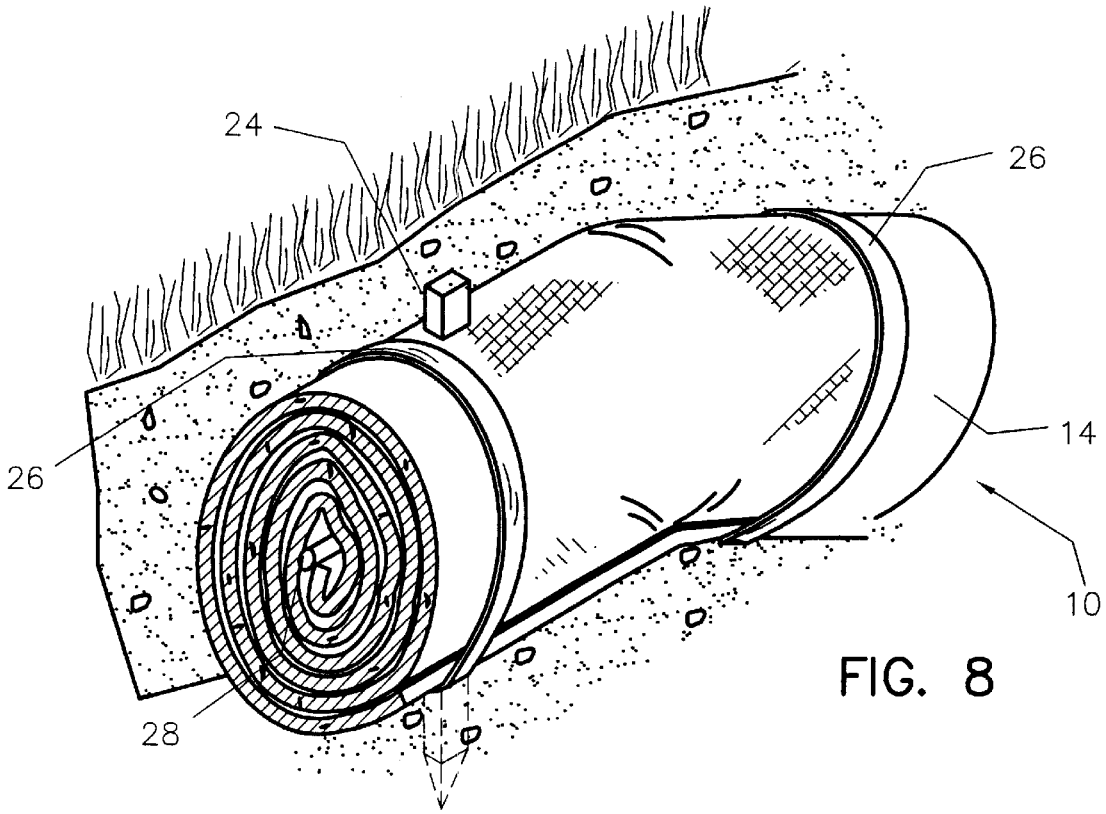
FIG. 8 is an environmental view of the synthetic hay bale of the present invention wherein a rod is passed through the rolled up body member and a stake passes through the body member.
Figure 9:
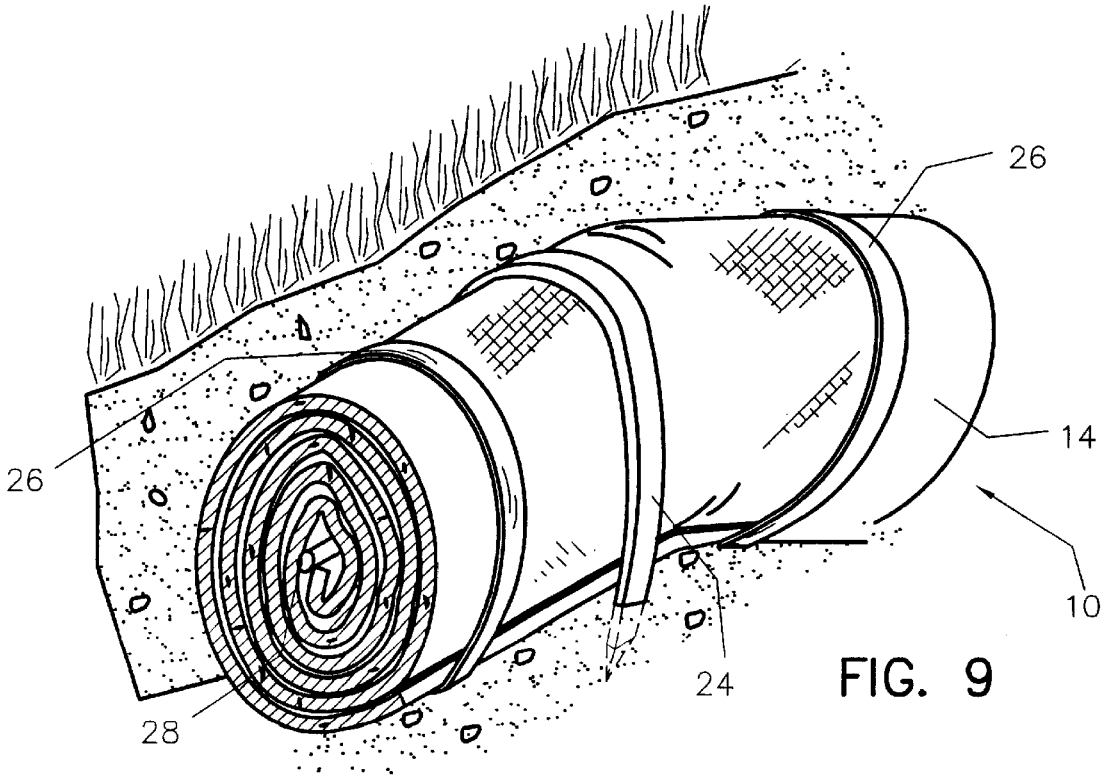
FIG. 9 is an environmental view of the synthetic hay bale of the present invention wherein a rod is passed through the rolled up body member and a stake straddles the body member.

Referring now to the drawings, it is seen that the synthetic hay bale of the present invention, generally denoted by reference numeral 10, is comprised of a sheet member 12, the sheet member 12 being formed from ground and packed carpet fibers. The sheet member 12 is rolled up to form a body member 14. The body member 14 may be received within a cover 16, the cover 16 having a first end 18 and a second end 20, and being formed from an appropriate mesh material such as rope, nylon, etc. One or both ends 18 and 20 of the cover 16 are closed or otherwise tied. Tying of the ends 18 and 20 can be accomplished in any appropriate fashion such as tying the appropriate end of the cover 16 around itself or providing an appropriate tying material 22, the tying material being made from rope, flexible plastic, metal, etc. The rolled up body member 14 may be encompassed by a strap 26 made from any appropriate material such as plastic, wire, rope, nylon, etc., in order to hold the body member 14 in the rolled up state. At least one stake 24 passes through the cover 16 (if used) and the body member 14, or the stake 24 can be of such design that it straddles the body member 14 in order to fixedly secure the body member to the ground. A hole can be pre-drilled into the body member 14 or the stake 24 can be driven into the body member by an appropriate method. A rod 28 may be longitudinally passed through the body member 14 so that the body member may be bent to a desired shaped (e.g., curved) with the rod 28, by also being bent, will hold its bent shape and thus hold the body member 14 in the desired shape. This allows the device 10 to be used in awkward locations such as at drain openings, the body member 14 being bent to fit the shape of the drain opening.

In order to use the synthetic hay bale 10 of the present invention, the synthetic hay bale 10 is positioned at the desired location and the at least one stake 22 is passed through the cover 16 and the body member 14 and into the ground G. If multiple synthetic hay bales 10 are to be positioned in side by side abutment along a lateral axis, the end 18 or 20 of the cover 16 that is next to another synthetic hay bale 10 is untied and the cover 16 of one synthetic hay bale 10 partially receives the adjoining synthetic hay bale 10 and vice versa. Water flows to the synthetic hay bale 10, and as the body member 14 is water permeable, the water passes through the body member 14. However, due to the packing of the carpet fibers used to make up the sheet member 12 and thus the body member 14, soil and sediments that are contained in the water are trapped by the body member 14, thereby controlling sediment flow and soil erosion. Once sufficient soil and sediment have been filtered by the device 10, the synthetic hay bale 10 may be hosed down or otherwise washed for reuse. Once the synthetic hay bale is no longer capable of adequate filtering, the body member 14 may be ground up, cleaned by an appropriate technique and rebuilt.

While the invention has been particularly shown and described with reference to an embodiment thereof, it will be appreciated by those skilled in the art that various changes in form and detail may be made without departing from the spirit and scope of the invention.

I claim:

1. A hay bale, for securement to the ground in a water flow path comprising a body member through which water can flow through, the body member being made from packed carpet fibers and being a relatively flat sheet member that is rolled up, the rolled up body member being fastened to the ground in the water flow path in the body member's rolled up state.

2. The hay bale as in claim 1 wherein the rolled up body member is fixedly secured to the ground with a stake.

3. The hay bale as in claim 2 wherein the stake passes through the body member.

4. The hay bale as in claim 2 wherein the stake straddles the body member and is received within the ground.

5. The hay bale as in claim 1 further comprising a cover having a first end and a second end such that the body member is received within an interior of the cover.

6. The hay bale as in claim 5 wherein the first end is tied.

7. The hay bale as in claim 6 wherein the second end is tied.

8. The hay bale as in claim 5 further comprising at least one stake passing through the cover and the body member.

9. The hay bale as in claim 5 wherein the cover is made from a mesh material.

10. The hay bale as in claim 1 further comprising a rod that is received within the body member.

11. A hay bale, for securement to the ground in a water flow path comprising:

a body member through which water can flow through, the body member being made from packed carpet fibers and being a relatively flat sheet member that is rolled up, the rolled up body member being fastened to the ground in the water flow path in the body member's rolled up state; and a rod is received within the body member.

12. The hay bale as in claim 11 wherein the rolled up body member is secured to the ground with a stake.

13. The hay bale as in claim 12 wherein the stake passes through the body member.

14. The hay bale as in claim 12 wherein the stake straddles the body member and is received within the ground.

15. The hay bale as in claim 11 further comprising a cover having a first end and a second end such that the body member is received within an interior of the cover.

16. The hay bale as in claim 15 wherein the first end is tied.

17. The hay bale as in claim 16 wherein the second end is tied.

18. The hay bale as in claim 15 further comprising at least one stake passing through the cover and the body member.

19. The hay bale as in claim 15 wherein the cover is made from a mesh material.

20. A method for water flow, soil erosion, and sediment control comprising the steps of:

providing a body member through which water can flow through, the body member being made from packed carpet fibers; and rolling the body member up; and fastening the rolled up body member to the ground in a water flow path in the body member's rolled up slate.

21. The method as in claim 20 wherein the body member is secured to the ground by using a stake.

22. The method as in claim 21 wherein the stake passes through the body member.

23. The method as in claim 21 wherein the stake straddles the body member and is received within the ground.

24. The method as in claim 20 wherein the body member is received within a cover, the cover having a first end and a second end.

25. The method as in claim 24 wherein the first end is tied.

26. The method as in claim 25 wherein the second end is tied.

27. The method as in claim 24 wherein the body member is secured to the ground by passing at least one stake through the cover and through the body member and into the ground.

28. The method as in claim 24 wherein the cover is made from a mesh material.

29. The method as in claim 20 wherein a rod is received within the body member.

30. A method for water flow, soil erosion, and sediment control comprising the steps of:

providing a body member through which water can flow through, the body member being made from packed carpet fibers; and rolling the body member up;

providing a rod and inserting the rod into the body member; and fastening the rolled up body member to the ground in a water flow path in the body member's rolled up state.

31. The method as in claim 30 wherein the body member is secured to the ground by using a stake.

32. The method as in claim 31 wherein the stake passes through the body member.

33. The method as in claim 31 wherein the stake straddles the body member and is received within the ground.

34. The method as in claim 30 wherein the body member is received within a cover, the cover having a first end and a second end.

35. The method as in claim 34 wherein the first end is tied.

36. The method as in claim 35 wherein the second end is tied.

37. The method as in claim 34 wherein the body member is secured to the ground by passing at least one stake through the cover and through the body member and into the ground.

38. The method as in claim 34 wherein the cover is made from a mesh material.

* * * * *